US006296409B1

(12) United States Patent
Cherry et al.

(10) Patent No.: US 6,296,409 B1
(45) Date of Patent: Oct. 2, 2001

(54) FLEXIBLE GRIP WITH PROMOTIONAL INDICIA AND HANDHELD ARTICLES INCORPORATING SAME

(75) Inventors: Paul Cherry, Weston, FL (US); Robert A. Jones, Raleigh, NC (US)

(73) Assignee: Adstracts, Inc., Raleigh, NC (US)

( * ) Notice: Subject to any disclaimer, the term of this patent is extended or adjusted under 35 U.S.C. 154(b) by 0 days.

(21) Appl. No.: 09/685,457

(22) Filed: Oct. 9, 2000

(51) Int. Cl.[7] ..... A46B 5/02

(52) U.S. Cl. ..... 401/6; 401/194; 16/430; D19/47

(58) Field of Search ..... 401/6, 88, 48, 401/194; 16/430, 421; D19/47, 41; 8/303, 305, 315

(56) References Cited

U.S. PATENT DOCUMENTS

| | | | | |
|---|---|---|---|---|
| D. 341,622 | * | 11/1993 | Poisson | 401/6 |
| 4,526,547 | * | 7/1985 | Rusk | 401/6 |
| 5,794,767 | * | 8/1998 | Wilson | 401/6 |
| 6,062,753 | * | 5/2000 | Hadtke et al. | 401/6 |

* cited by examiner

*Primary Examiner*—David J. Walczak
(74) *Attorney, Agent, or Firm*—Myers Bigel Sibley & Sajovec

(57) ABSTRACT

Finger grips having tactile, promotional indicia extending outwardly therefrom that can facilitate the grasping of various handheld devices including, but not limited to, writing instruments, hand tools, and the like, are provided. A finger grip includes an elongated tube of resilient, deformable material that is configured to fit snugly around an elongated portion of a handheld article. Tactile promotional indicia in the form of raised lettering extends outwardly from the finger grip.

12 Claims, 7 Drawing Sheets

FLEXIBLE GRIP WITH PROMOTIONAL INDICIA AND HANDHELD ARTICLES INCORPORATING SAME

FIELD OF THE INVENTION

The present invention relates generally to handheld articles and, more particularly, to devices for grasping handheld devices.

BACKGROUND OF THE INVENTION

The use of promotional items has proliferated in today's increasingly competitive marketplace, where companies are constantly seeking more effective and new ways to market their products. In the healthcare industry, physicians and other healthcare providers often receive promotional articles from vendors of healthcare-related products, such as pharmaceutical products. These promotional articles often include "everyday" items, such as writing pads, calendars, and pens that have promotional information (indicia) printed thereon. For example, pharmaceutical companies often provide physicians with writing pens having the name of a particular pharmaceutical product printed thereon with the hopes that the pens will help remind the physicians to prescribe the particular pharmaceutical product.

Unfortunately, because of lack of distinctiveness, many promotional articles provided to healthcare providers often become "lost-in-the-shuffle" with other promotional articles. Thus, there is a need for distinctive, more effective promotional products directed to healthcare providers as well as to others.

Promotional items, such as writing instruments (e.g., pens and pencils) generally include a barrel which is held in the hand of a user for writing, and include a writing tip which communicates with a source of ink. Often the barrels of pens and pencils are formed of wood or are molded of a synthetic material that has a smooth finish that can inhibit a user's ability to grip the barrel and to write effectively. Attempts have been made to enhance the grip of writing instruments by surrounding a portion of the barrel with rubber-like covering material. In addition, separate attachment devices have been made and marketed to be attached to a standard writing instrument to improve a user's grip.

Grips which may be attached to the barrels of writing instruments are well known in the art. For example, U.S. Pat. No. 4,832,604 to Rusk describes a writing aid designed to aid a user in holding a writing instrument properly. Other known grips are designed to facilitate a user's grasp of a writing instrument without instructional or corrective functions. U.S. Pat. No. 4,932,800 to Lin et al., U.S. Pat. No. 5,926,901 to Tseng et al., and U.S. Pat. No. 5,056,945 to Klodt each describe compressible finger gripping devices that can be slidably secured around the surface portion of a writing instrument.

Unfortunately, conventional writing instruments and devices for improving a user's grasp thereof often have limited marketing and promotional appeal.

SUMMARY OF THE INVENTION

In view of the above discussion, a novel finger grip having tactile, promotional indicia extending outwardly therefrom that can facilitate the grasping of various handheld devices including, but not limited to, writing instruments, hand tools, and the like, is provided. A finger grip according to an embodiment of the present invention includes an elongated tube of resilient, deformable material that is configured to fit snugly around an elongated portion (e.g., a barrel or handle) of a handheld article. Tactile promotional indicia is displayed on an outer surface of the finger grip.

Promotional indicia is preferably in the form of raised lettering that extends outwardly from the outer surface and that is integrally formed with the tube. According to an embodiment of the present invention, the raised lettering may be arranged in one or more circumferentially extending rows. Multiple rows may be spaced apart along a longitudinal direction and in a circumferentially staggered configuration. According to another embodiment of the present invention, raised lettering (e.g., alphabetical characters) may be arranged in one or more longitudinally extending columns. Multiple columns may be spaced apart circumferentially in a staggered configuration.

According to another embodiment of the present invention, promotional indicia, such as lettering, may extend inwardly into the outer surface of a finger grip. As with outwardly extending lettering, inwardly extending promotional indicia may be arranged in rows, or columns, or a combination of rows and columns, and may have various configurations.

According to another embodiment of the present invention, a finger grip having tactile raised lettering integrally formed therewith surrounds a portion of an elongated barrel of a writing instrument, such as a pen. The tube and tactile raised lettering are formed from resilient, deformable material.

Finger grips according to the present invention can facilitate grasping handheld articles and can provide a distinctive promotional effect for various handheld articles.

According to another embodiment of the present invention, a writing instrument includes an elongated barrel of resilient, deformable material. Tactile promotional indicia in the form of raised lettering is integrally formed with an outer surface of the barrel. The lettering may be arranged in a plurality of circumferentially extending rows that are spaced apart along the longitudinal direction and/or a plurality of longitudinally extending columns that are circumferentially spaced apart around the barrel.

DETAILED DESCRIPTION OF THE INVENTION

Figure 1:
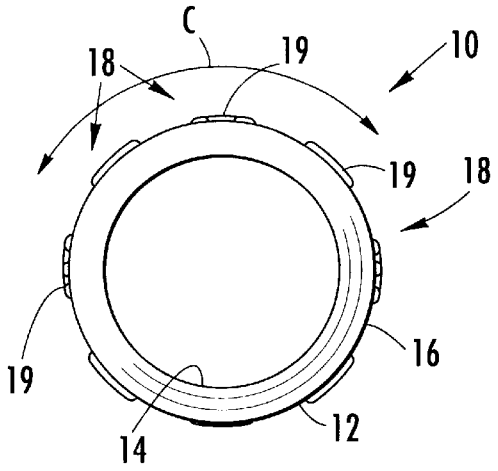
FIG. 1 is a front elevational view of a finger grip having promotional indicia extending from an outer surface thereof, according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings.

Referring now to FIGS. 1–4, an improved finger grip 10 according to an embodiment of the present invention is illustrated. The illustrated finger grip 10 can facilitate the grasping of various handheld devices including, but not limited to, writing instruments, hand tools, and the like. The illustrated finger grip 10 comprises an elongated tube 12 of resilient, deformable material that is configured to fit snugly around an elongated portion (e.g., a barrel, handle, etc.) of a handheld article. For example, in FIG. 3, the finger grip 10 surrounds a portion of the barrel of a pencil. The finger grip 10 includes an inner surface 14 and an outer surface 16. The inner surface 14 is configured to contact portions of a handheld article and maintain the finger grip 10 secured thereto. Tactile promotional indicia 18 extends outwardly from the outer surface 16. The elongated tube 12 may be formed of natural or synthetic rubber, and may be formed of a moldable, resilient polymeric material.

Figure 2:
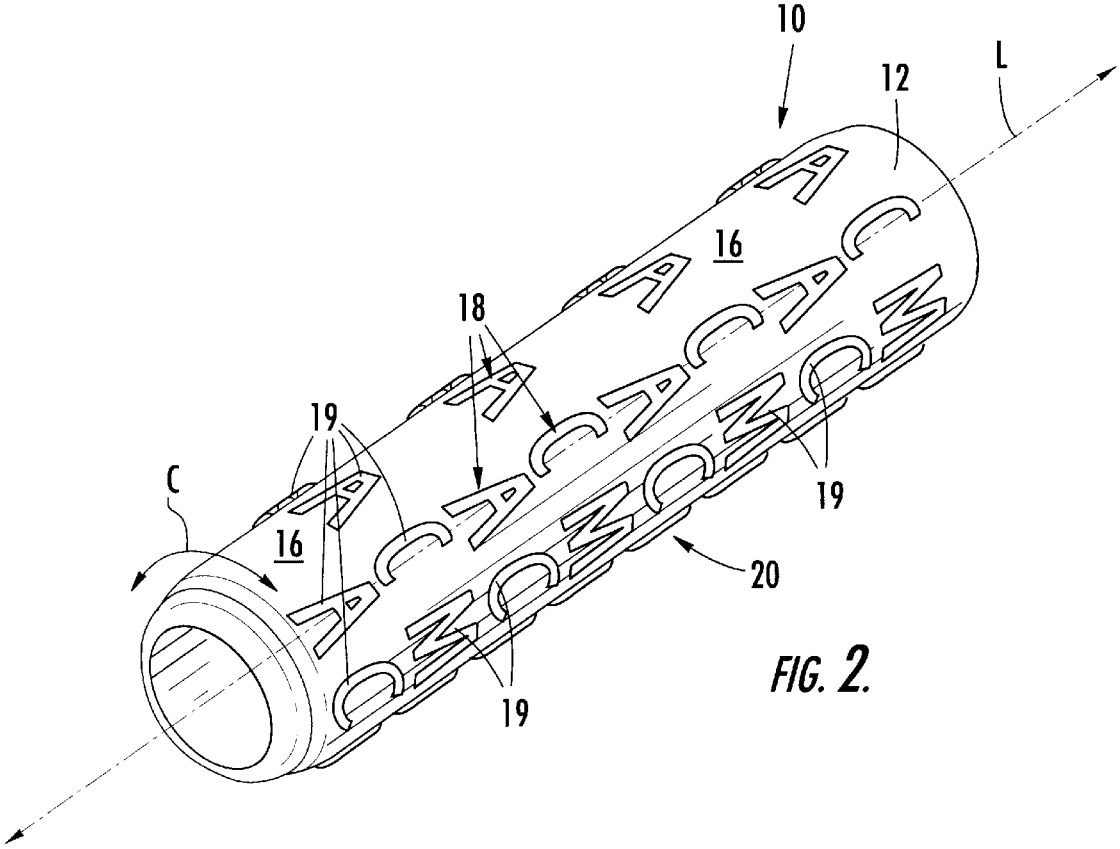
FIG. 2 is a perspective view of the finger grip of FIG. 1.
Figure 3:
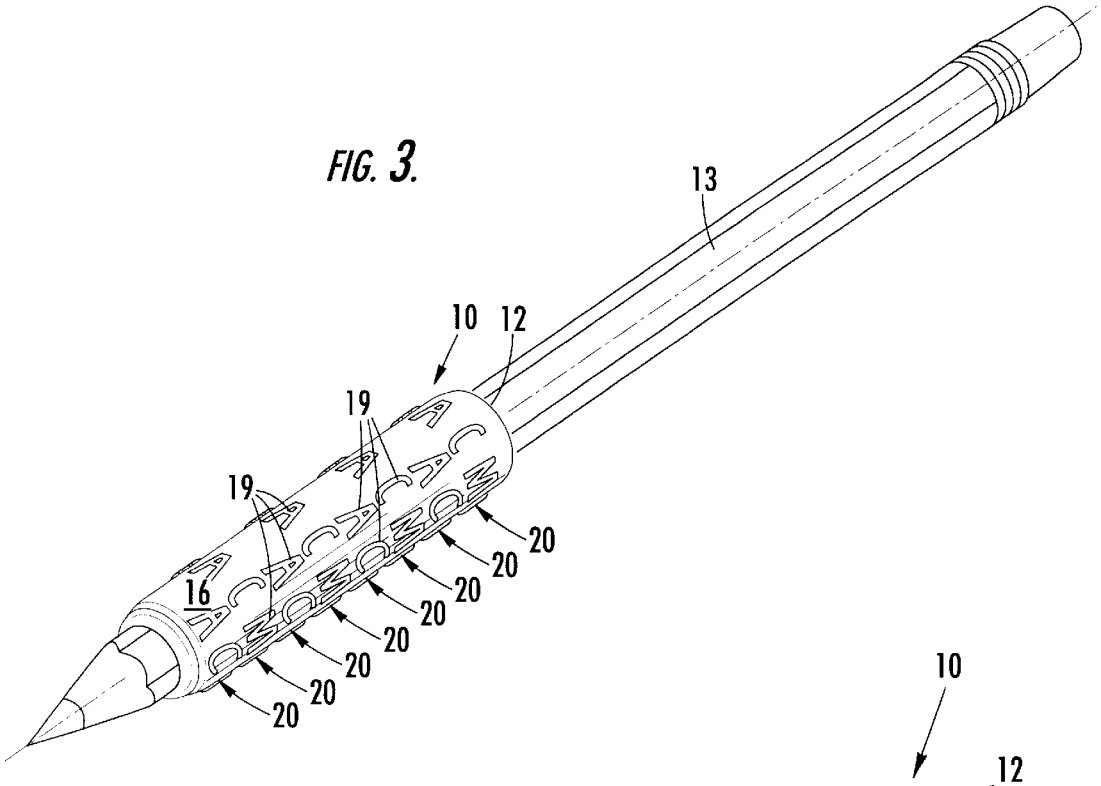
FIG. 3 is a perspective view of the finger grip of FIG. 1 surrounding a portion of an elongated barrel of a pencil.
Figure 4:
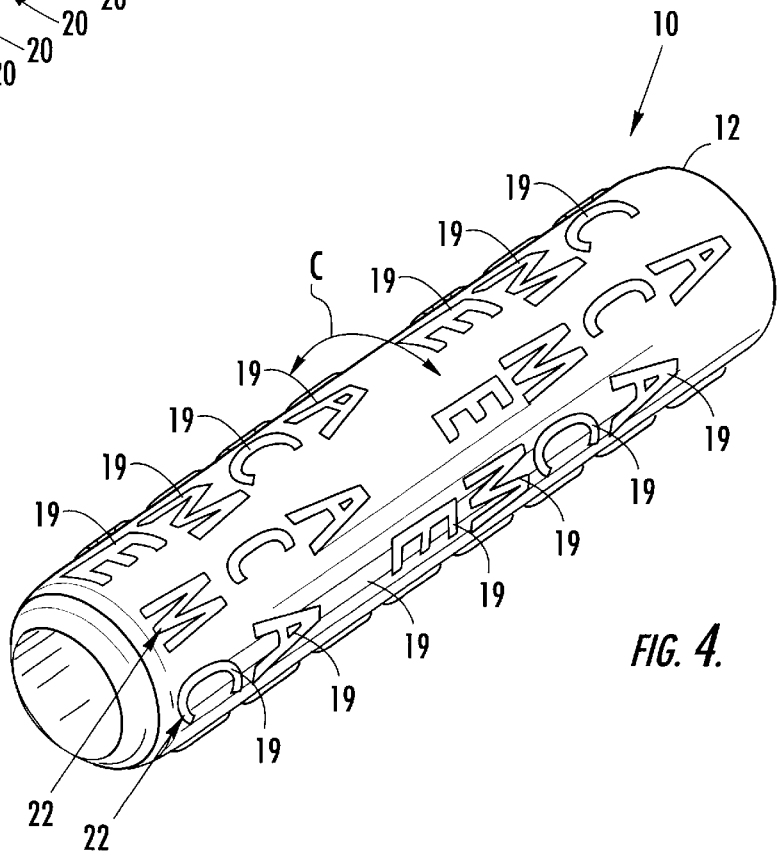
FIG. 4 is a perspective view of an improved finger grip according to another embodiment of the present invention wherein promotional indicia in the form of raised lettering is arranged in a plurality of staggered, longitudinally extending columns.

In the illustrated embodiment, the promotional indicia is in the form of raised lettering 19 that extends outwardly from the outer surface 16 and that is integrally formed with the elongated tube 12. In FIGS. 2 and 3, the raised lettering 19 is arranged in a plurality of circumferentially extending rows 20, wherein the lettering 19 in each row 20 spells the promotional term "ACME." The rows 20 are spaced apart along the longitudinal direction L in a circumferentially staggered configuration, as illustrated. In FIG. 4, raised lettering 19 is arranged in one or more longitudinally extending columns 22. The columns 22 are spaced apart circumferentially (indicated by C) in a longitudinally staggered configuration, as illustrated.

It is understood that rows 20 and columns 22 of raised lettering 19 can be arranged in various patterns and configurations. For example, rows 20 may be staggered circumferentially (as illustrated in FIG. 2), or longitudinally, or circumferentially and longitudinally. Columns 22 may be staggered longitudinally (as illustrated in FIG. 4), circumferentially, or longitudinally and circumferentially.

Finger grips according to embodiments of the present invention may include various types of promotional indicia, including, but not limited to lettering, designs, characters, logos and other symbols. The term "lettering" as used herein includes, but is not limited to, alphabetical characters and alphanumeric characters.

Figure 5:
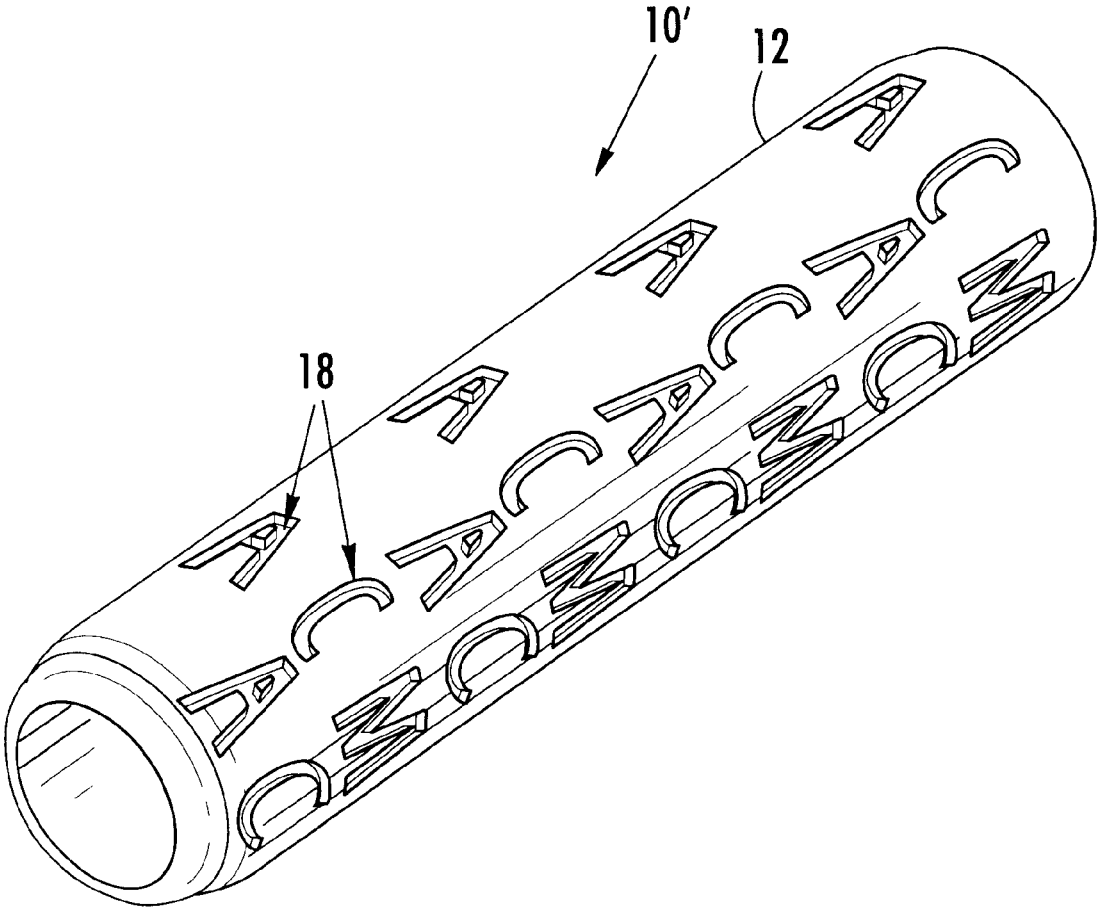
FIG. 5 is a perspective view of an improved finger grip according to another embodiment of the present invention wherein promotional indicia in the form of lettering extends inwardly into the outer surface of the tube.

According to another embodiment of the present invention, illustrated in FIG. 5, promotional indicia 18, such as lettering, may extend inwardly into the outer surface 16 of a finger grip 10'. As with outwardly extending lettering, inwardly extending lettering may be arranged in rows, or columns, or a combination of rows and columns, and having various configurations.

Figure 6:
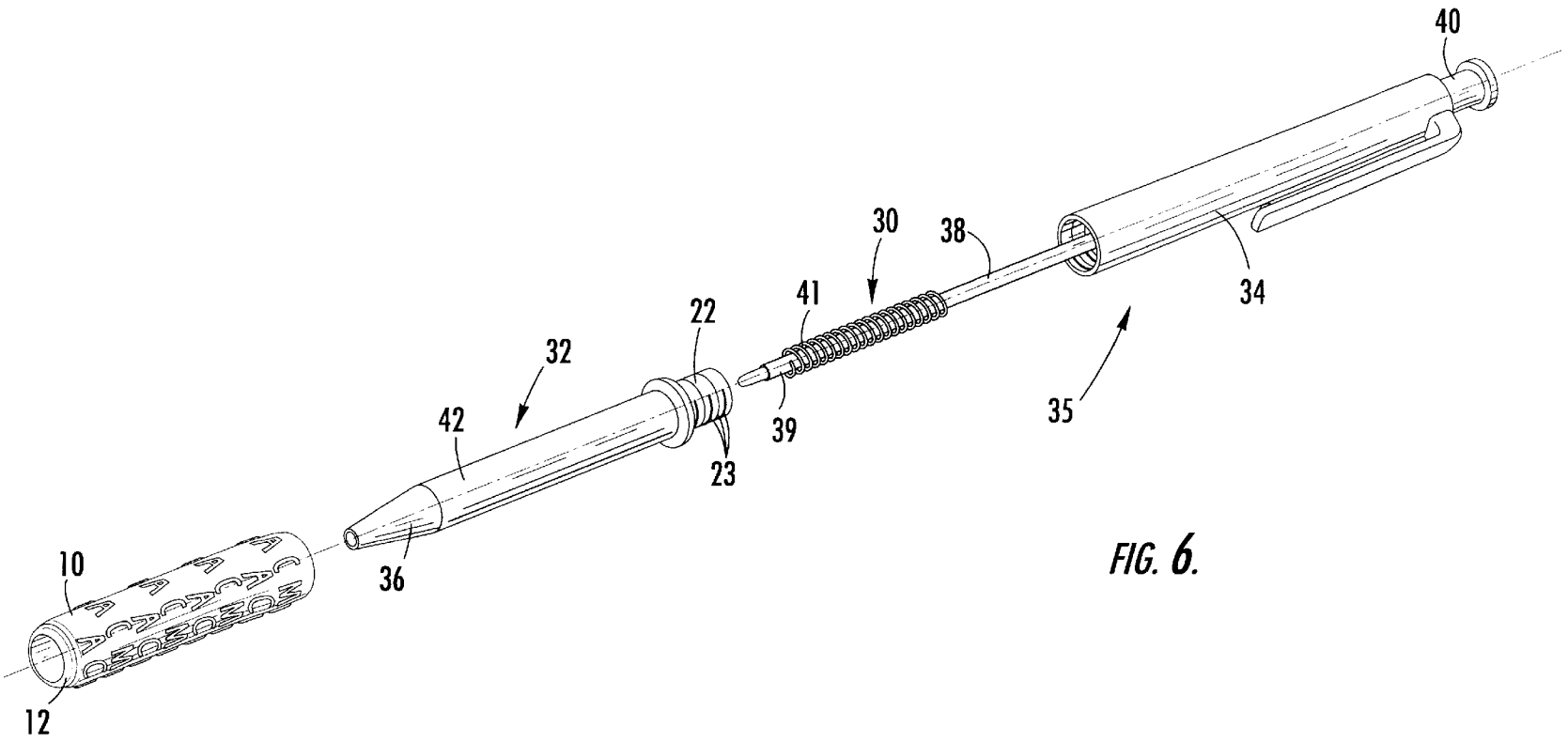
FIG. 6 is an exploded perspective view of a writing instrument incorporating a finger grip with promotional indicia, according to an embodiment of the present invention.
Figure 7:
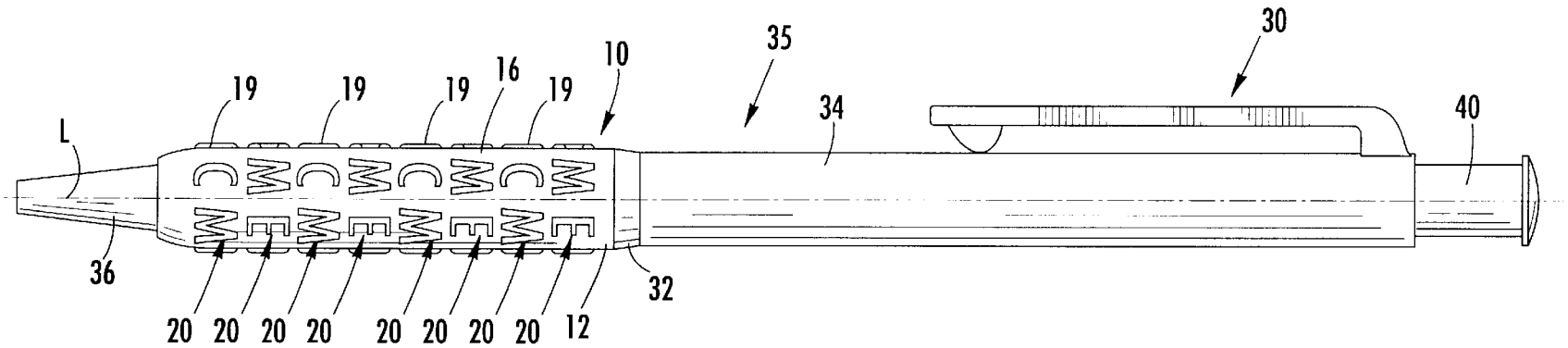
FIG. 7 is a plan view of the writing instrument of FIG. 6 in an assembled configuration.

Referring now to FIGS. 6 and 7, a writing instrument 30 of the ball point pen type is illustrated and includes a cylindrical first barrel portion 32, a cylindrical second barrel portion 34 (collectively referred to hereinafter as the barrel 35), and a barrel tip 36. The second barrel portion 34 is threadably received onto the first barrel portion 32 with the ball point 39 retained within the barrel tip 36.

The writing instrument 30 includes an ink containing element 38 having a ball point 39 at one end and the opposite end thereof mechanically connected to an actuator button 40 extending from the second barrel portion 34. A spring 41 is provided to retract the ink containing element 38 rearwardly into the barrel 35, and consequently the ball point 39 into the barrel tip 36 when the actuator button 40 is released and the writing instrument 30 is not in use. The ink containing element 38 and ball point 39 are well known to those of skill in the art, and will not be further described herein.

The first barrel portion 32 includes a cylindrical rear portion 22 having threads 23 formed thereon for receiving the second barrel portion 34, and a cylindrical front portion 42. The cylindrical front portion 42 is configured to receive, in close fitting engagement, a finger grip 10 according to embodiments of the present invention. An assembled writing pen 30 is illustrated in FIG. 7.

The illustrated finger grip 10 includes a cylindrical tube 12 of resilient, deformable material having an outer surface 16, and tactile raised lettering 19 integrally formed with the tube 12. The raised lettering 19 is effective to prevent slippage of a user's fingers during operation of the writing instrument 30.

In the illustrated embodiment of FIGS. 6 and 7, the promotional indicia 18 is in the form of raised lettering 19 that extends outwardly from the tube outer surface 16 and is integrally formed therewith. The raised lettering 19 is arranged in a plurality of circumferentially extending rows 20, wherein the lettering 19 in each row spells the promotional term "ACME." The rows 20 are spaced apart along the longitudinal direction L in a circumferentially staggered configuration, as illustrated.

Figure 8:
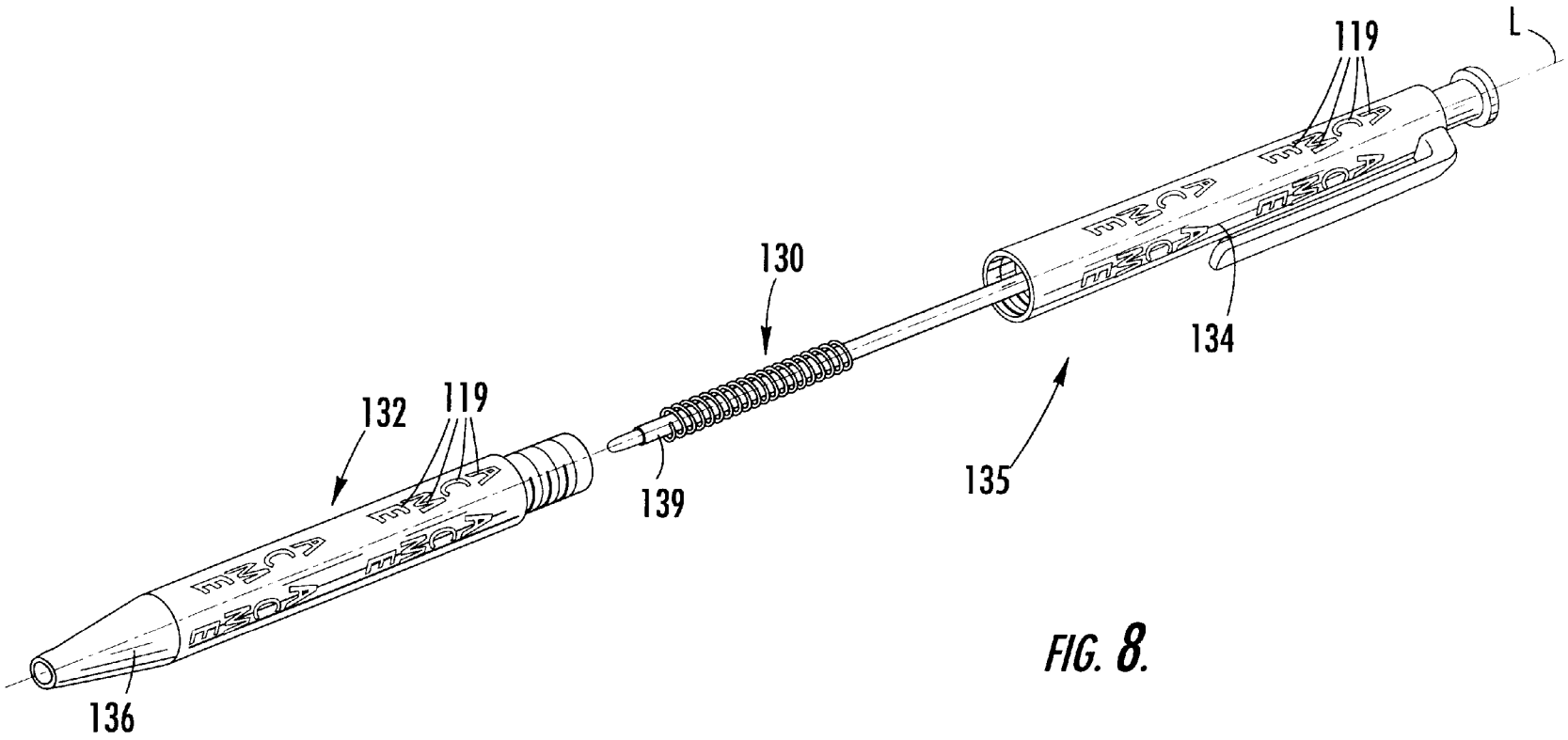
FIG. 8 is an exploded perspective view of a writing instrument having a barrel formed from resilient, deformable material and incorporating tactile, promotional indicia thereon, according to another embodiment of the present invention.
Figure 9:
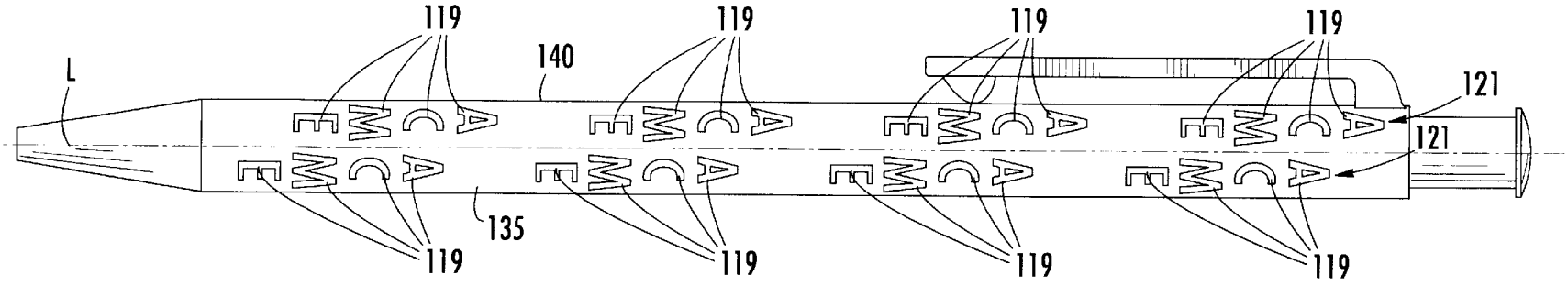
FIG. 9 is a plan view of the writing instrument of FIG. 8 in an assembled configuration.

Referring now to FIGS. 8 and 9, a writing instrument 130 according to another embodiment of the present invention is illustrated. The illustrated writing instrument 130 is of the ball point pen type as described above and includes a cylindrical first barrel portion 132, a cylindrical second barrel portion 134 (collectively referred to hereinafter as the barrel 135), and a barrel tip 136. The second barrel portion 134 is threadably received onto the first barrel portion 132 with the ball point 139 retained within the barrel tip 136 as described above. An assembled writing pen 130 is illustrated in FIG. 9.

Referring now to FIG. 9, the barrel 135 defines a longitudinal direction L and is preferably (but need not be) formed from a resilient, deformable material. Tactile promotional indicia in the form of raised lettering 119 is integrally formed with an outer surface 140 of the barrel 135. The raised lettering 119 is effective to prevent slippage of a user's fingers during operation of the writing instrument 130.

The tactile, raised lettering 119 is preferably formed from a resilient, deformable material. In the illustrated embodiment of FIGS. 8 and 9, the tactile, raised lettering 119 is arranged in a plurality of longitudinally extending columns 121 that are spaced apart circumferentially around the barrel 135 in a staggered configuration. The lettering 119 in each column 121 spells the promotional term "ACME." Alternatively, the tactile, raised lettering 119 may be arranged in a plurality of circumferentially extending rows that are spaced apart along the longitudinal direction L. In addition, tactile, promotional indicia, such as lettering, may extend inwardly into the barrel outer surface 140 in a manner similar to that described above with respect to FIG. 5.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A finger grip, comprising:

an elongated tube of resilient, deformable material configured to fit snugly around an elongated portion of a handheld article, and comprising an outer surface; and tactile promotional indicia integrally formed with the outer surface and extending outwardly therefrom, wherein the tactile promotional indicia comprises lettering, and wherein the lettering is arranged in at least one of a plurality of circumferentially extending rows spaced apart along the longitudinal direction and a plurality of longitudinally extending columns circumferentially spaced apart.

2. The finger grip according to claim 1, wherein the at least one of a plurality of circumferentially extending rows and a plurality of longitudinally extending columns are spaced apart in a staggered configuration.

3. A handheld article, comprising:

an elongated barrel that defines a longitudinal direction; and a finger grip element surrounding a portion of the elongated barrel, comprising:

a tube of resilient, deformable material having an outer surface; and tactile promotional indicia integrally formed with the tube outer surface and extending outwardly therefrom, wherein the tactile promotional indicia comprises lettering, and wherein the lettering is arranged in at least one of a plurality of circumferentially extending rows spaced apart along the longitudinal direction and a plurality of longitudinally extending columns circumferentially spaced apart.

4. The handheld article according to claim 3, wherein the at least one of a plurality of circumferentially extending rows and a plurality of longitudinally extending columns are spaced apart in a staggered configuration.

5. A writing instrument, comprising:

an elongated barrel having a writing tip end and defining a longitudinal direction; and a finger grip element surrounding a portion of the elongated barrel adjacent the writing tip end, comprising:

a tube of resilient, deformable material having an outer surface; and tactile promotional indicia integrally formed with the outer surface and extending outwardly therefrom, wherein the tactile promotional indicia comprises lettering, and wherein the lettering is arranged in at least one of a plurality of circumferentially extending rows spaced apart along the longitudinal direction and a plurality of longitudinally extending columns circumferentially spaced apart.

6. The writing instrument according to claim 5, wherein the at least one of a plurality of circumferentially extending rows and a plurality of longitudinally extending columns are spaced apart in a staggered configuration.

7. A finger grip, comprising:

an elongated tube of resilient, deformable material configured to fit snugly around an elongated portion of a handheld article, and comprising an outer surface; and tactile promotional indicia integrally formed with the outer surface and extending only partially inwardly into the outer surface, wherein the tactile promotional indicia comprises lettering, and wherein the lettering is arranged in at least one of a plurality of circumferentially extending rows spaced apart along the longitudinal direction and a plurality of longitudinally extending columns circumferentially spaced apart.

8. The finger grip according to claim 7, wherein the at least one of a plurality of circumferentially extending rows and a plurality of longitudinally extending columns are spaced apart in a staggered configuration.

9. A handheld article, comprising:

an elongated barrel that defines a longitudinal direction; and a finger grip element surrounding a portion of the elongated barrel, comprising:

a tube of resilient, deformable material having an outer surface; and tactile promotional indicia integrally formed with the tube outer surface and extending only partially inwardly into the outer surface, wherein the tactile promotional indicia comprises lettering, and wherein the lettering is arranged in at least one of a plurality of circumferentially extending rows spaced apart along the longitudinal direction and a plurality of longitudinally extending columns circumferentially spaced apart.

10. The handheld article according to claim 9, wherein the at least one of a plurality of circumferentially extending rows and a plurality of longitudinally extending columns are spaced apart in a staggered configuration.

11. A writing instrument, comprising:

an elongated barrel having a writing tip end and defining a longitudinal direction; and a finger grip element surrounding a portion of the elongated barrel adjacent the writing tip end, comprising:

a tube of resilient, deformable material having an outer surface; and tactile promotional indicia integrally formed with the outer surface and extending only partially inwardly into the outer surface, wherein the tactile promotional indicia comprises lettering, and wherein the lettering is arranged in at least one of a plurality of circumferentially extending rows spaced apart along the longitudinal direction and a plurality of longitudinally extending columns circumferentially spaced apart.

12. The writing instrument according to claim 11, wherein the at least one of a plurality of circumferentially extending rows and a plurality of longitudinally extending columns are spaced apart in a staggered configuration.

* * * * *